US006779220B1

(12) United States Patent
Raffa

(10) Patent No.: US 6,779,220 B1
(45) Date of Patent: Aug. 24, 2004

(54) CYLINDRICAL HAIR BRUSH CLEANER

(76) Inventor: Caroline Raffa, P.O. Box 6, Syosset, NY (US) 11791

( * ) Notice: Subject to any disclaimer, the term of this patent is extended or adjusted under 35 U.S.C. 154(b) by 59 days.

(21) Appl. No.: 10/304,097

(22) Filed: Nov. 25, 2002

(51) Int. Cl.[7] ..... A46B 17/06
(52) U.S. Cl. ..... 15/142; 132/150; 132/160
(58) Field of Search ..... 15/104.5, 142; 132/219, 107, 119, 149, 150, 160; 119/625, 630, 632, 633; D28/21, 30–31, 33–34

(56) References Cited

U.S. PATENT DOCUMENTS

| | | | | | |
|---|---|---|---|---|---|
| 339,137 | A | | 4/1886 | Brookbank | |
| 939,290 | A | | 11/1909 | Myers | |
| 1,183,528 | A | * | 5/1916 | Bongiovanni | 15/142 |
| 1,280,821 | A | | 10/1918 | O'Leary | |
| 1,381,973 | A | * | 6/1921 | Davis | 15/104.001 |
| 1,425,923 | A | | 8/1922 | Weyhraugh | |
| 1,633,893 | A | * | 6/1927 | Hymer | 132/150 |
| 1,689,209 | A | | 10/1928 | Majewski | |
| 2,084,603 | A | | 6/1937 | True | |
| 2,230,610 | A | | 2/1941 | Solomon | |
| D137,784 | S | * | 4/1944 | Motley | D28/22 |
| 2,529,012 | A | * | 11/1950 | Gleekman | 119/632 |
| 2,564,721 | A | | 8/1951 | Raya | |
| 2,856,622 | A | | 10/1958 | Jacobsen | |
| 3,170,182 | A | | 2/1965 | Burian | |
| 3,999,244 | A | | 12/1976 | Brickley | |
| 5,603,137 | A | * | 2/1997 | Hasan | 15/176.1 |
| 5,922,139 | A | * | 7/1999 | Gilbert | 134/6 |
| 5,930,862 | A | | 8/1999 | Garrett | |

* cited by examiner

*Primary Examiner*—Mark Spisich
(74) *Attorney, Agent, or Firm*—Michael I. Kroll

(57) ABSTRACT

The present invention 10 discloses a partially cylindrical shaped hairbrush cleaner having teeth or tines 16 projecting longitudinally from the structure 26 forming an arc on one end and a gripping handle 22 on the other end. The tines 16 are made of a material suitable to resist bending, therefore, slots 20 are made extending beyond the tine base 24 into the structural member forming flexible ribbing 18 whereby forces 36 applied to the distal end of the tines will cause them to conform to the cylindrically shaped brush being cleaned. The present invention 10 will remove debris such as hair, threads and line 38 from cylindrically shaped hairbrushes 12. The device can be provided with various shaped handles 40, 42, 44 and 50.

6 Claims, 13 Drawing Sheets

CYLINDRICAL HAIR BRUSH CLEANER

BACKGROUND OF THE INVENTION

1. Field of the Invention

The present invention relates generally to hairbrush cleaning devices and, more specifically, to a partially cylindrical shaped hairbrush cleaner having teeth or tines projecting radially from the structure forming an arc. The tines are made of a material suitable to resist bending, therefore slots are made extending beyond the tine base into the structural member forming flexible ribbing whereby forces applied to the distal end of the tines will cause them to conform to the cylindrically shaped brush being cleaned. The device of the present invention will remove debris such as hair, threads and lint from cylindrically shaped hairbrushes. The device can be provided with various shaped handles all having a proximal end and a distal end. The user of the device of the present invention grips the proximal end opposite the distal end coupling the projecting tines.

2. Description of the Prior Art

There are other brush cleaning devices designed for cleaning debris from the brush. Typical of these is U.S. Pat. No. 339,137 issued to Brookbank on Apr. 6, 1886.

Another patent was issued to Myers on Nov. 9, 1909 as U.S. Pat. No. 939,290. Yet another U.S. Pat. No. 1,280,821 was issued to O'Leary on Oct. 8, 1918 and still yet another was issued on Oct. 30, 1928 to Majewski as U.S. Pat. No. 1,689,209.

Another patent was issued to True on Jun. 22, 1937 as U.S. Pat. No. 2,084,603. Yet another U.S. Pat. No. 2,230,610 was issued to Solomon on Feb. 4, 1941. Another was issued to Raya on Aug. 21, 1951 as U.S. Pat. No. 2,564,721 and still yet another was issued on Oct. 21, 1958 to Jacobsen as U.S. Pat. No. 2,856,622.

Another patent was issued to Burian on Feb. 23, 1965 as U.S. Pat. No. 3,170,182. Yet another U.S. Pat. No. 3,999,244 was issued to Brickley on Dec. 28, 1976. Another was issued to Garrett on Aug. 3, 1999 as U.S. Pat. No. 5,930,862 and still another to Weyhrauch on Aug. 15, 1922 as U.S. Pat. No. 1,425,923.

U.S. Pat. No. 339,137

Inventor: James Brookbank

Issued: Apr. 6, 1886

This invention relates to a device for cleaning brushes and combs and consists in a handle or body of suitable form provided at one end with a brush and at the opposite end with thin curved fingers of metal or equivalent material adapted to enter between the teeth of a comb or brush.

U.S. Pat. No. 939,290

Inventor: Fanny Myers

Issued: Nov. 9, 1909

The invention relates to devices for cleaning the brushes of carpet cleaners having teeth designed, when applied to a revoluble brush, to extend radially in relation thereto so as to prevent the threads, hair, etc., from pulling off of the teeth.

U.S. Pat. No. 1,280,821

Inventor: Richard O'Leary

Issued: Oct. 8, 1918

The invention relates to a device adapted to be used in cleaning the teeth of toilet combs.

U.S. Pat. No. 1,689,209

Inventor: Clara Majewski

Issued: 1,689,209

This invention relates to a brush cleaner from which the removed dirt and hairs may be readily discharged.

U.S. Pat. No. 2,084,603

Inventor: Shirley True

Issued: Jun. 22, 1937

The present invention relates to improvements in comb cleaners that remove from the roots of combs teeth foreign matter and other impurities.

U.S. Pat. No. 2,230,610

Inventor: Nathan Solomon

Issued: Feb. 4, 1941

This invention is a comb cleaner with a spiral brush on a rotatable shaft sustained in spaced depending bearings of a supporting handle.

U.S. Pat. No. 2,564,721

Inventor: Julian Raya

Issued: Aug. 21, 1951

This invention relates to cleaning devices adapted for the use in cleaning various types of brushes specially pertaining to a comb like device capable of removing hair, threads or other filamentary material from the bristles of a brush.

U.S. Pat. No. 2,856,622

Inventor: Ferdinand Jacobsen

Issued: Oct. 21, 1958

This invention relates to an improved paintbrush cleaning tool and more specifically to a combined cleaning comb and scraper tool particularly adapted for cleaning paint brushes.

U.S. Pat. No. 3,170,182

Inventor: Franklin Burian

Issued: Feb. 3, 1965

This invention relates to brush cleaning tools of the kind having teeth which are worked through the bristles of a paintbrush.

U.S. Pat. No. 3,999,244

Inventor: Alfred Brickley

Issued: Dec. 28, 1976

A rake for raising and combing the pile of a rug, carpet or the like having a head and an elongated handle attached thereto. The head has a plurality of prongs arranged along an edge opposite said handle in at least two spaced, parallel rows with the individual prongs for each row arrange in alternating fashion. The head of the rack and the prongs are formed in a unitary, one piece molded construction. The cantilever, double row arrangement of the prongs allows the downward force of the prongs to be essentially equal with the first row of prongs providing a raising effect on the piles with the following rows combing the pile. The cross section of the prongs is curved in a convex-concave configuration which blends into the head to provide reinforcing and additional strength in the prongs.

U.S. Pat. No. 5,930,862

Inventor: Barbara Garrett

Issued: Aug. 3, 1999

The rug rack is used for removing dead and unwanted hairs from a pile of a floor covering, such as either a rug or a carpet. The rug rake includes an elongated handle and rake head. The handle has a proximal end and a distal end. A person grips the proximal end of the handle. The rake head is coupled to the distal end of the handle. The rack head includes a rectangularly shaped steel support plate and a rectangularly shape matrix of a plurality of tin plated wire bristles. Each tin plated wire bristle has a distal end and is bent at the distal end thereof.

U.S. Pat. No. 1,425,923

Inventor: Frederick Weyhrauch

Issued: Aug. 15, 1922

The invention relates to improvements in brush cleaners for use primarily in cleaning rotary brushes such as are used in carpet sweepers, vacuum cleaners and the like and the object of the invention is to produce a cleaner which may be cheaply manufactured, efficient and capable of use by anyone.

While these brush cleaning devices may be suitable for the purposes for which they were designed, they would not be as suitable for the purposes of the present invention, as hereinafter described. The present invention is a partially cylindrical shaped hairbrush cleaner having teeth or tines projecting radially from the structure forming an arc. The tines are made of a material suitable to resist bending, therefore slots are made extending beyond the tine base into the structural member forming flexible members whereby forces applied to the distal end of the tines will cause them to conform to the cylindrically shaped brush being cleaned. The device of the present invention will remove debris such as hair and lint from cylindrically shaped hairbrushes. The device can be provided with various shaped handles as shown within the provided art of the present invention.

SUMMARY OF THE PRESENT INVENTION

The present invention discloses a partially cylindrical shaped hairbrush cleaner having teeth or tines projecting longitudinally from the structure forming an arc and a gripping handle. The tines are made of a material suitable to resist bending, therefore, slots are made extending beyond the tine base into the structural member forming flexible ribbing whereby forces applied to the distal end of the tines will cause them to conform to the cylindrically shaped brush being cleaned. The present invention will remove debris such as hair, threads and line from cylindrically shaped hairbrushes. The device can be provided with various shaped handles.

A primary object of the present invention is to provide a partially cylindrically shaped hairbrush cleaner.

Another object of the present invention is to provide a partially cylindrically shaped hairbrush cleaner having teeth or tines projecting radially from the structure forming an arc.

Yet another object of the present invention is to provide a partially cylindrically shaped hair brush cleaner having tines that are made of a suitable material to resist bending.

Still yet another object of the present invention is to provide a partially cylindrically shaped hair brush cleaner having tines that are made of a material suitable to resist bending, therefore slots are made extending beyond the tine base into the structural member forming flexible ribbing.

Another object of the present invention is to provide a partially cylindrically shaped hair brush cleaner having flexible ribbing whereby forces applied to the distal end of the tines will cause them to conform to the cylindrically shaped brush being cleaned.

Additional objects of the present invention will appear as the description proceeds.

The present invention overcomes the shortcomings of the prior art by providing a partially cylindrically shaped hair brush cleaner having teeth or tines projecting radially from the structure forming an arc. The tines are made of a material suitable to resist bending, therefore slots are made extending beyond the tine base into the structural member forming flexible ribbing whereby forces applied to the distal end of the tines will cause them to conform to the cylindrically shaped brush being cleaned. The device of the present invention will remove debris such as hair and lint from cylindrically shaped hairbrushes. The device can be provided with various shaped handles as shown within the provided art of the present invention.

The foregoing and other objects and advantages will appear from the description to follow. In the description reference is made to the accompanying drawings, which form a part hereof and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
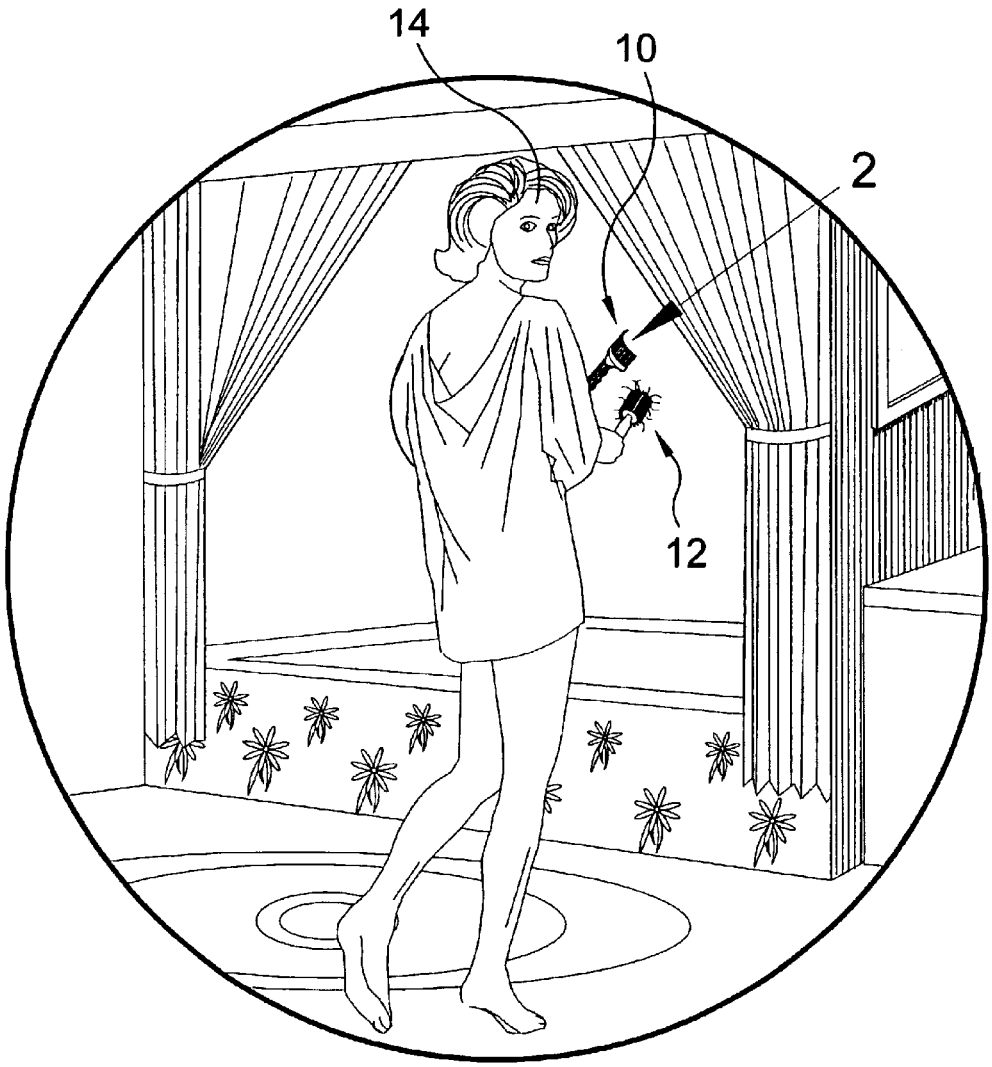
FIG. 1 is an illustrative view of the present invention in use.

With regard to reference numerals used, the following numbering is used throughout the drawings.

10 present invention
12 hair brush
14 user
16 teeth/tines
18 flexible ribbing
20 slots
22 handle
23 finger grip
24 base of tine
26 arc structure member
30 arc
32 distal end of tine
34 hook
36 applied force
38 hair and lint
40 alternate handle
41 aperture
42 alternate handle
44 alternate handle
46 inward contour
48 grip
50 alternate handle

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10, a partially cylindrical shaped hair brush cleaner for the removal of hair from a hair brush, which cleaner has teeth projecting longitudinally or lengthwise from the structure forming an arc for the removal of lint, hair and debris from a cylindrical shaped brush 12. The present invention 10 also has a handle to conform to the user's 14 hand.

Figure 2:
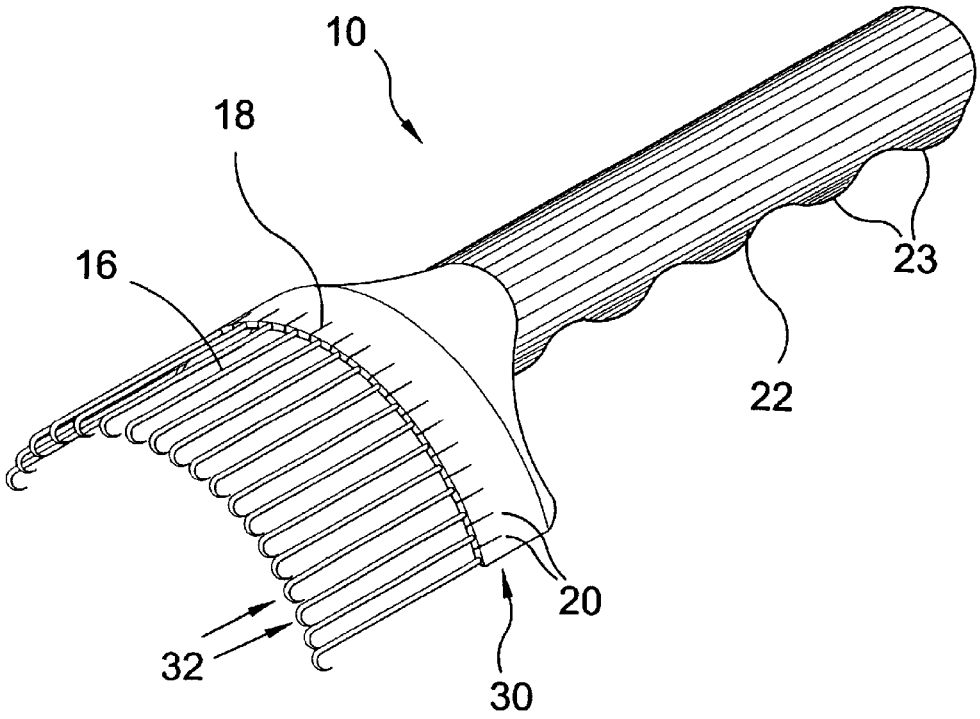
FIG. 2 is a perspective view of the present invention.

Turning to FIG. 2, shown therein is a perspective view of the present invention 10. The present invention 10 is a partially cylindrical shaped hairbrush cleaner, having teeth or tines 16 projecting longitudinally or lengthwise from the structure forming an arc 30. The tines 16 are made of a material suitable for being stiffened to resist bending, therefore slots 20 are made extending beyond the tine base into the structural member forming flexible ribbing 18 whereby forces applied to the distal end 32 of the tine will cause them to conform to the cylindrical shaped brush being cleaned. An elongated handle 22 having a plurality of finger grips 23 thereon for being gripped by a user is also shown.

Figure 3:
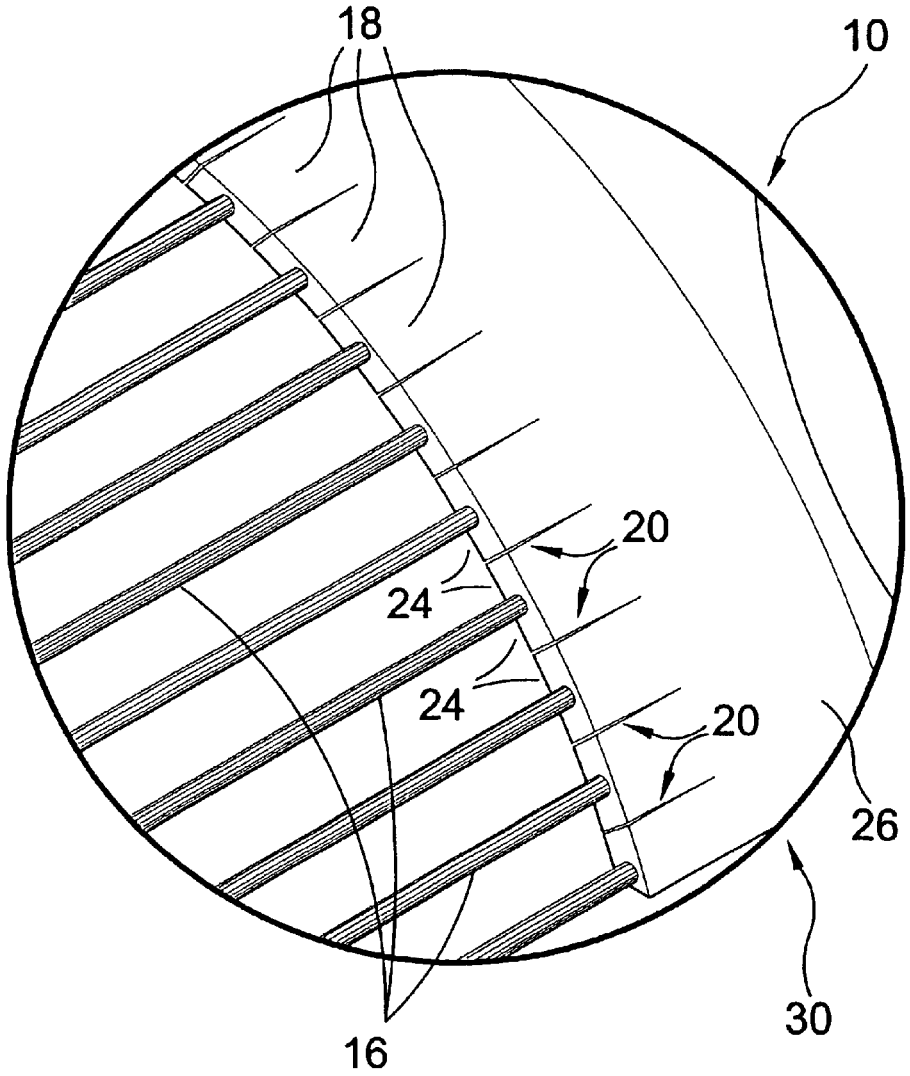
FIG. 3 is a detailed view of the present invention.

Turning to FIG. 3, shown therein is a detailed view of the present invention 10. The tines 16 of the present invention 10 are made of a material suitable to resist bending, therefore slots 20 are made extending beyond the tine base 24 into the structural member 26 of the arc 30 forming flexible ribbing whereby forces applied to the distal end of the tine will cause them to conform to the cylindrical shaped brush being cleaned.

Figure 4:
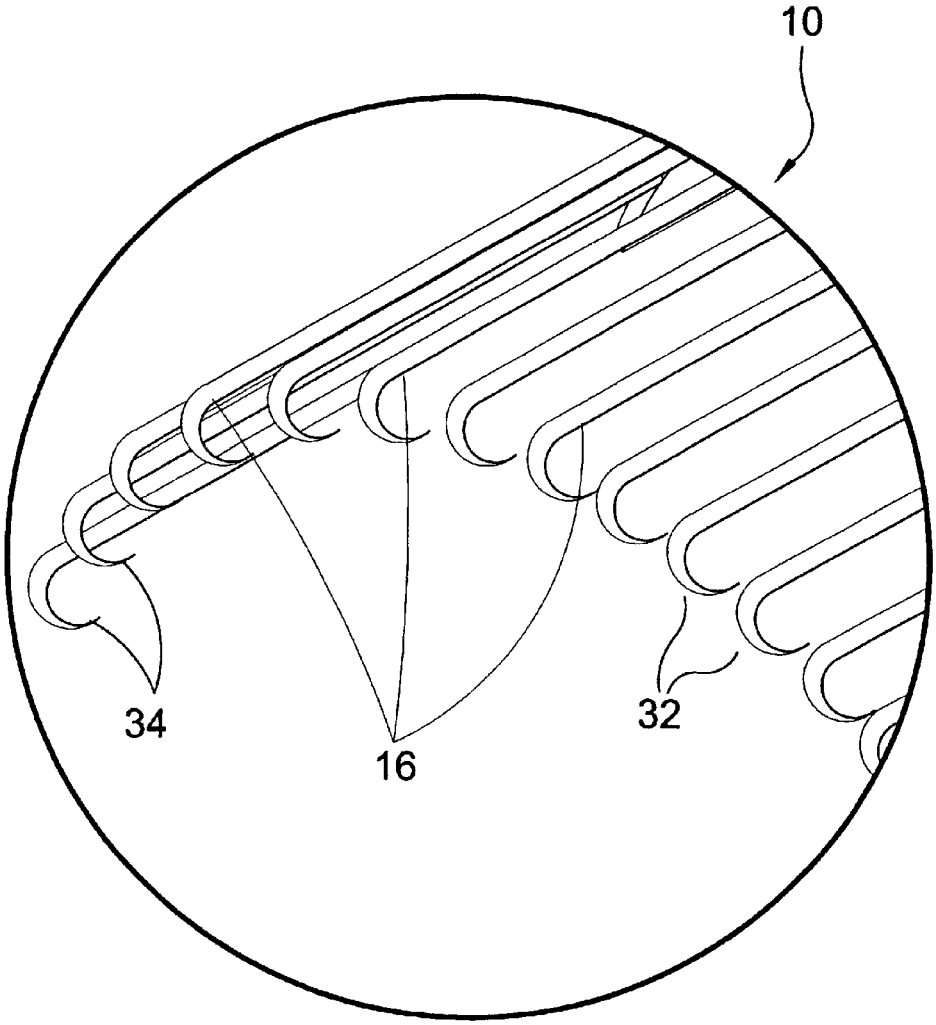
FIG. 4 is a detailed view of the present invention.

Turning to FIG. 4, shown therein is a detailed view of the present invention 10. The tines 16 of the present invention 10 are made of a material suitable to resist bending, therefore slots are made extending beyond the tine base into the structural member forming flexible ribbing whereby forces applied to the distal end 32 of the tine will cause them to conform to the cylindrical shaped brush being cleaned. Also shown is a tine hook 34 on the distal end of each tine 16.

Figure 5:
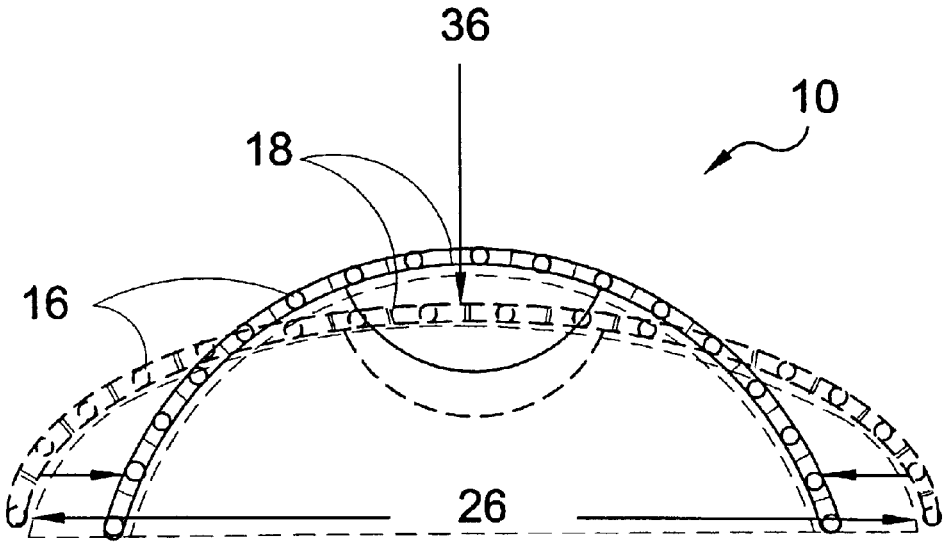
FIG. 5 is a frontal view of the present invention.

Turning to FIG. 5, shown therein is a frontal view of the present invention 10. The tines 16 of the present invention 10 are made of a material suitable to resist bending, therefore slots are made extending beyond the tine base into the structural member forming flexible ribbing 18 whereby forces applied shown by arrow 36 to the distal end of the tine 16 will cause the flexible ribbing 18 and flexible structural member 26 to conform to the cylindrical shaped brush being cleaned.

Figure 6:
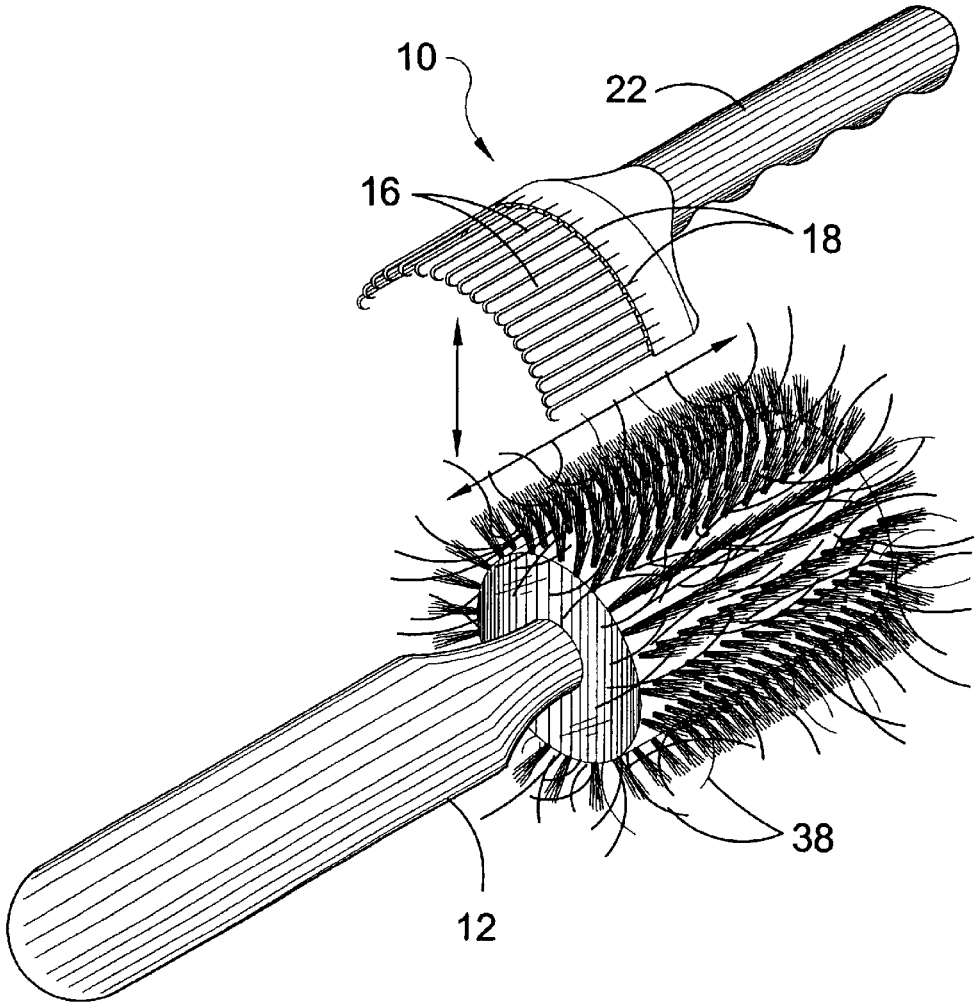
FIG. 6 is an illustrative view of the present invention in use.

Turning to FIG. 6, shown therein is an illustrative view of the present invention 10 in use. Shown is the cylindrical brush cleaning device of the present invention 10 about to be placed upon and drawn through a brush 12 to remove debris such as hair and lint 38 from the brush. The tines 16, handle 22 and flexible ribbing 18 of the present invention 10 are also shown.

Figure 7:
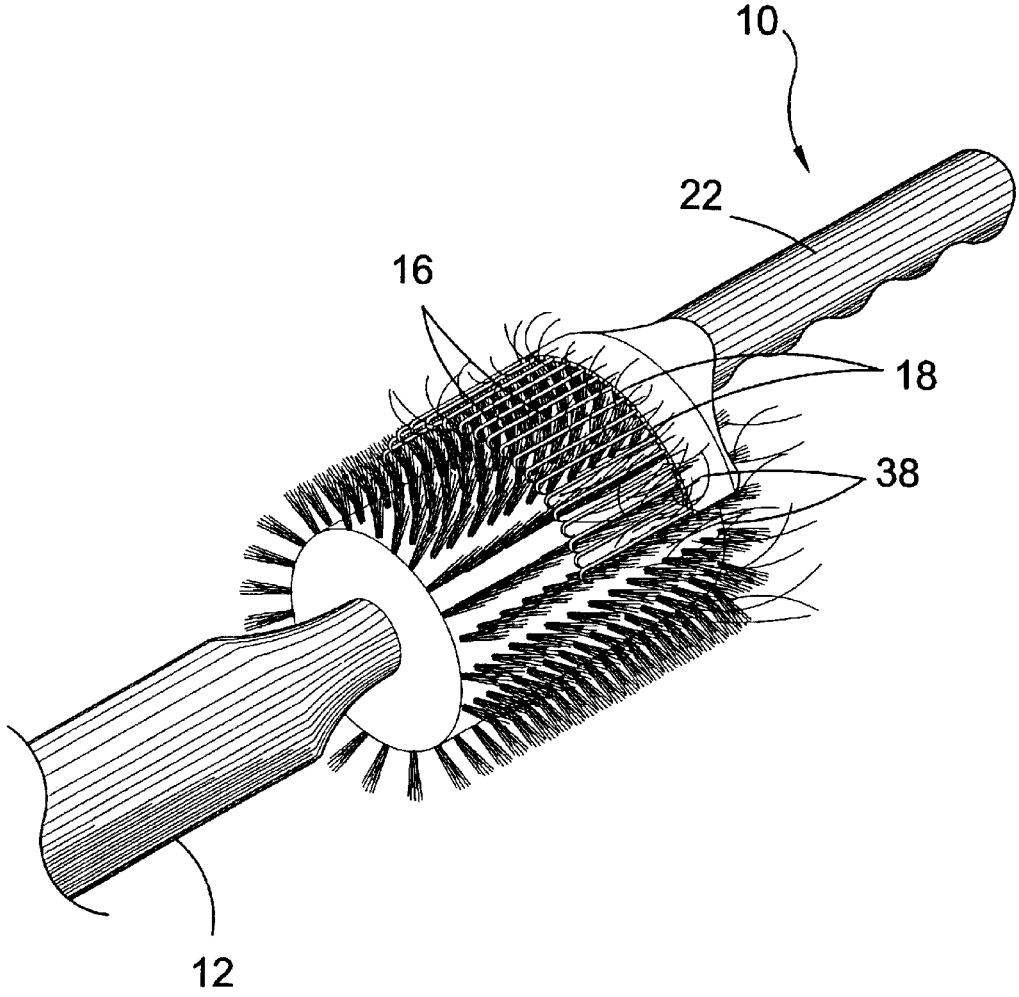
FIG. 7 is an illustrative view of the present invention in use.

Turning to FIG. 7, shown therein is an illustrative view of the present invention 10 in use. Shown is the partially cylindrical shaped hairbrush cleaner 10, having teeth or tines 16 projecting longitudinally from the structure being drawn through a cylindrical brush 12 removing debris and hair 38 as it is drawn. Other elements previously disclosed are also shown.

Figure 8:
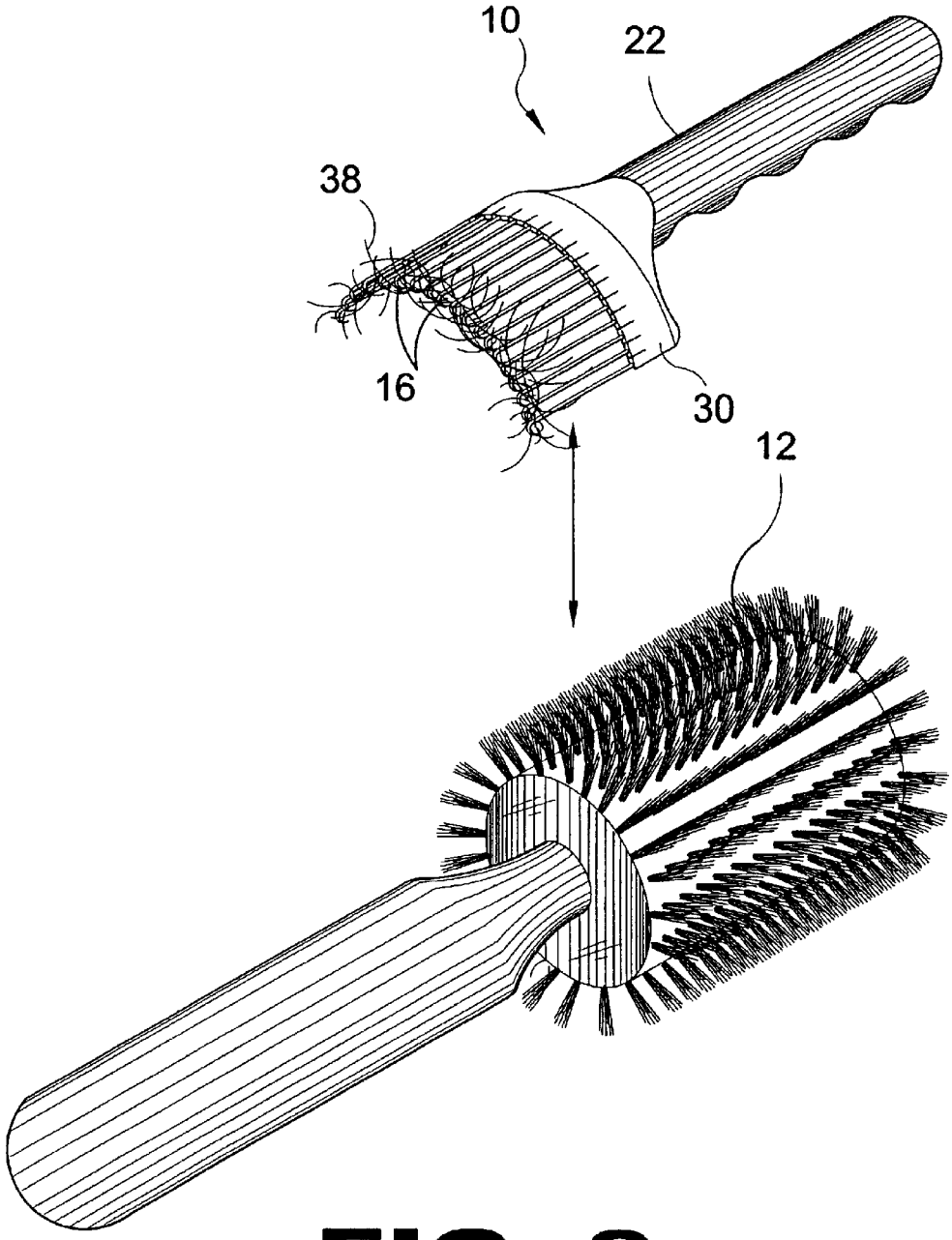
FIG. 8 is an illustrative view of the present invention in use.

Turning to FIG. 8, shown therein is an illustrative view of the present invention 10 in use. The present invention 10, a partially cylindrical shaped hairbrush cleaner, has teeth or tines 16 projecting longitudinally from the structure forming an arc 30. The tines 16 are made of a material suitable to resist bending, therefore, as previously disclosed, slots are made extending beyond the tine base into the structural member forming flexible ribbing whereby forces applied to the distal end of the tine will cause them to conform to the cylindrical shaped brush 12 being cleaned. Also shown are handle 22 and hair and lint 38.

Figure 9:
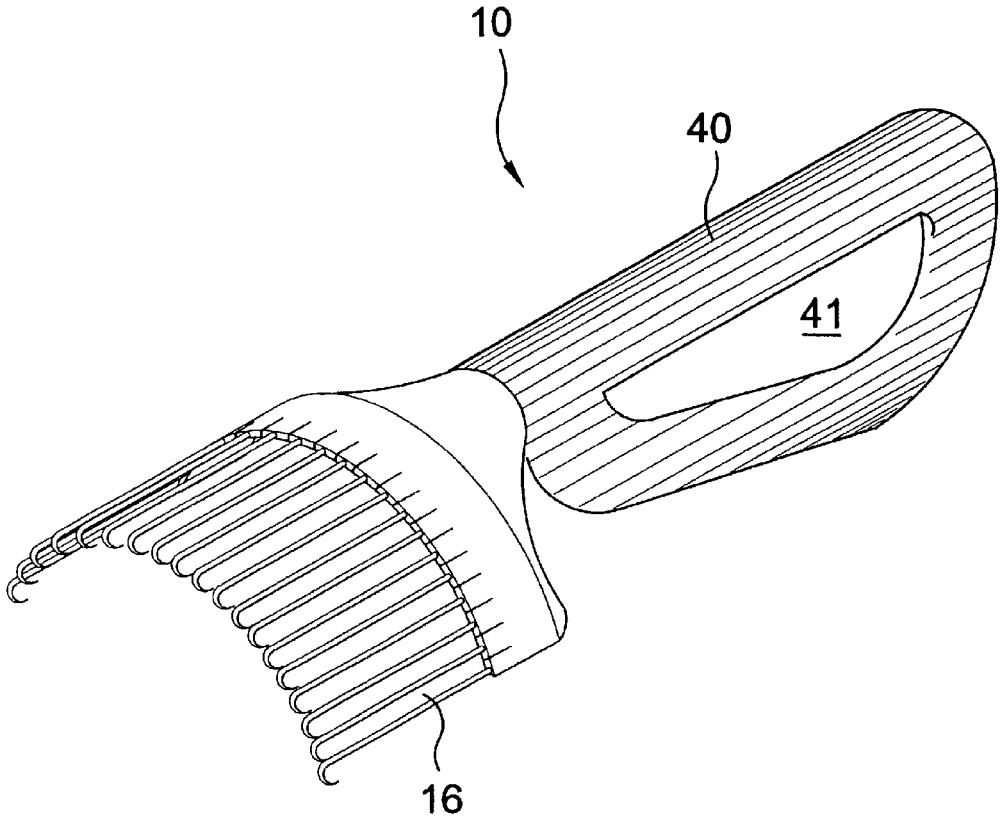
FIG. 9 is an alternate view of the present invention in use.

Turning to FIG. 9, shown therein is an alternate view of the present invention 10. Shown is the partially cylindrical shaped hairbrush cleaner, having an alternate shaped handle 40 with aperture 41 therein at one distal end and teeth or tines 16 projecting radially from the structure at the other distal end.

Figure 10:
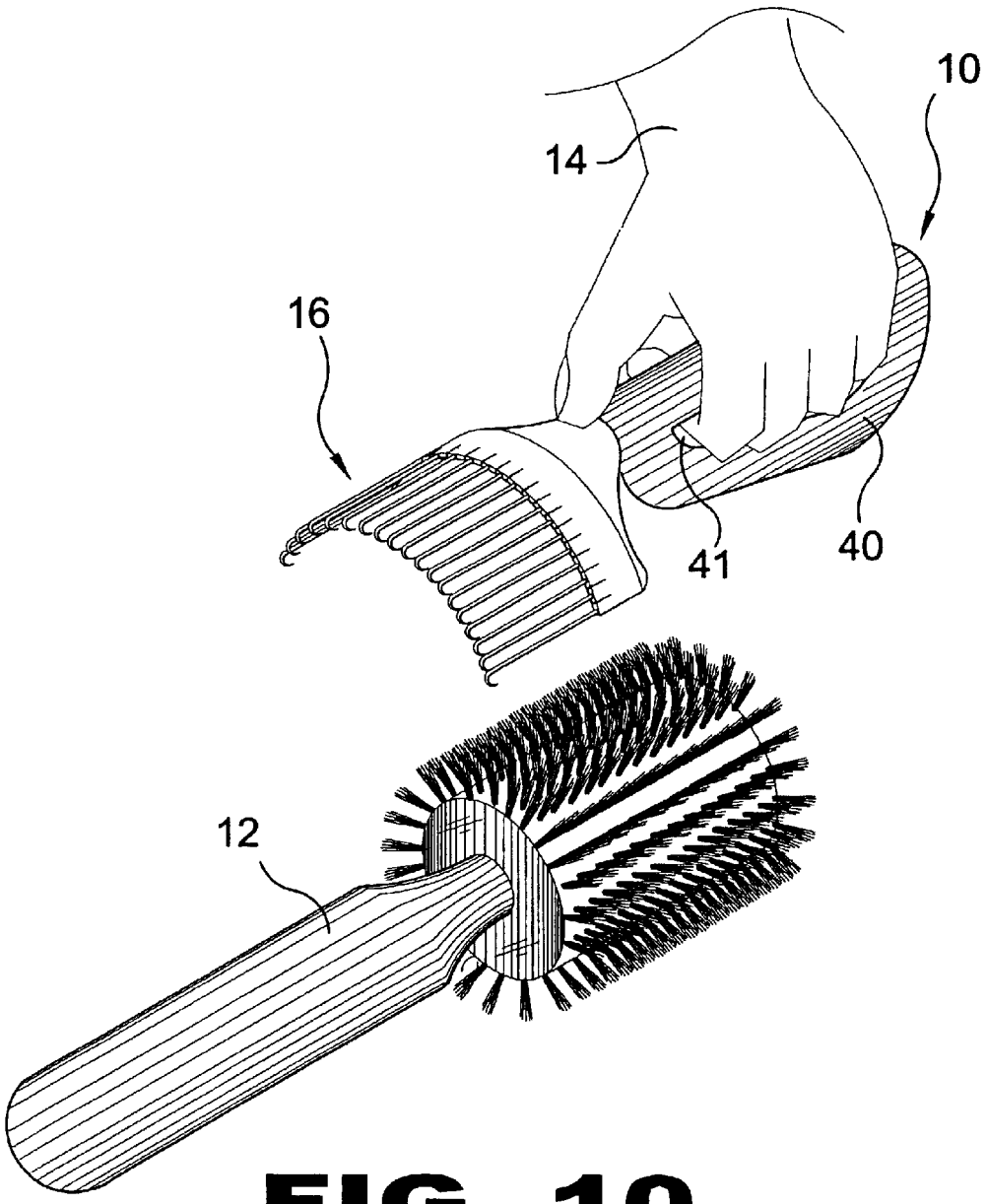
FIG. 10 is an alternate view of the present invention in use.

Turning to FIG. 10, shown therein is an alternate view of the present invention 10. Shown is the partially cylindrical shaped hairbrush cleaner, having an alternate shaped handle 40 with aperture 41 therein at one distal end and teeth or tines 16 projecting radially from the structure at the other distal end. Also shown is hairbrush 12. Aperture 41 receives a plurality of fingers of the user 14.

Figure 11:
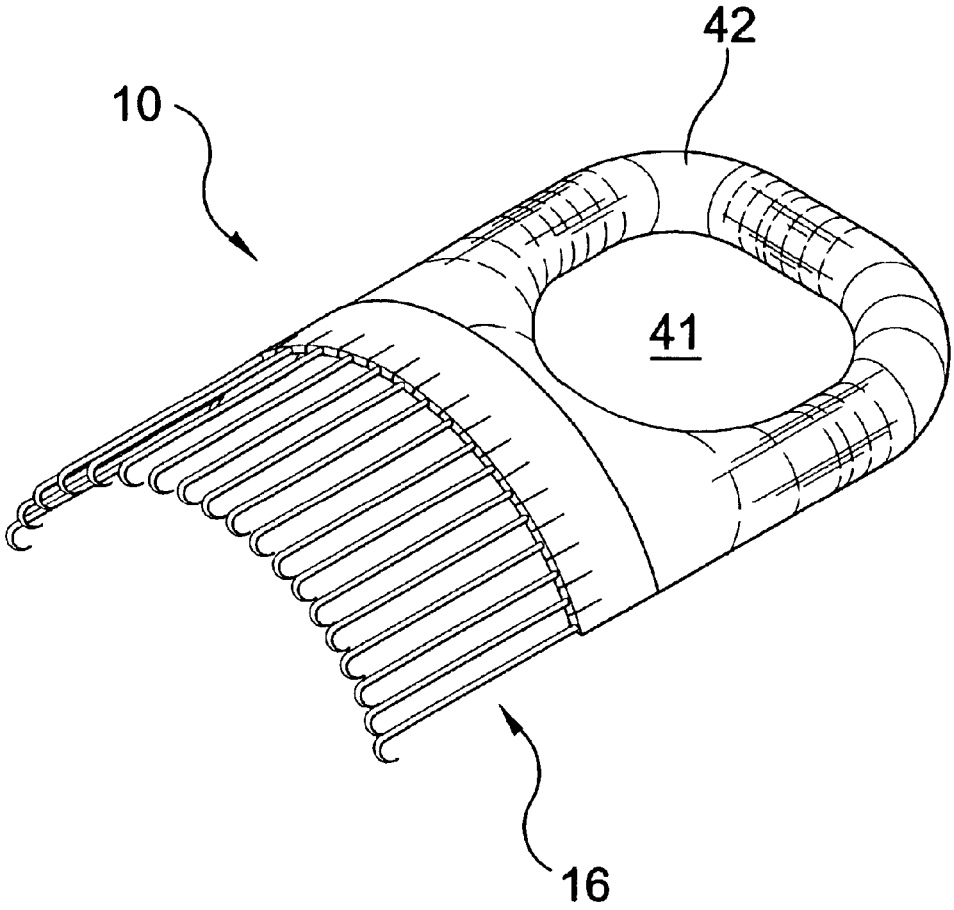
FIG. 11 is an alternate handle for the present invention.

Turning to FIG. 11, shown therein is an alternate handle 42 for the present invention 10. Shown is the partially cylindrically shaped hair brush cleaner having an alternately shaped handle 42 comprised of an appropriately sized aperture 41 for inserting a number of fingers. Tines 16 are also shown.

Figure 12:
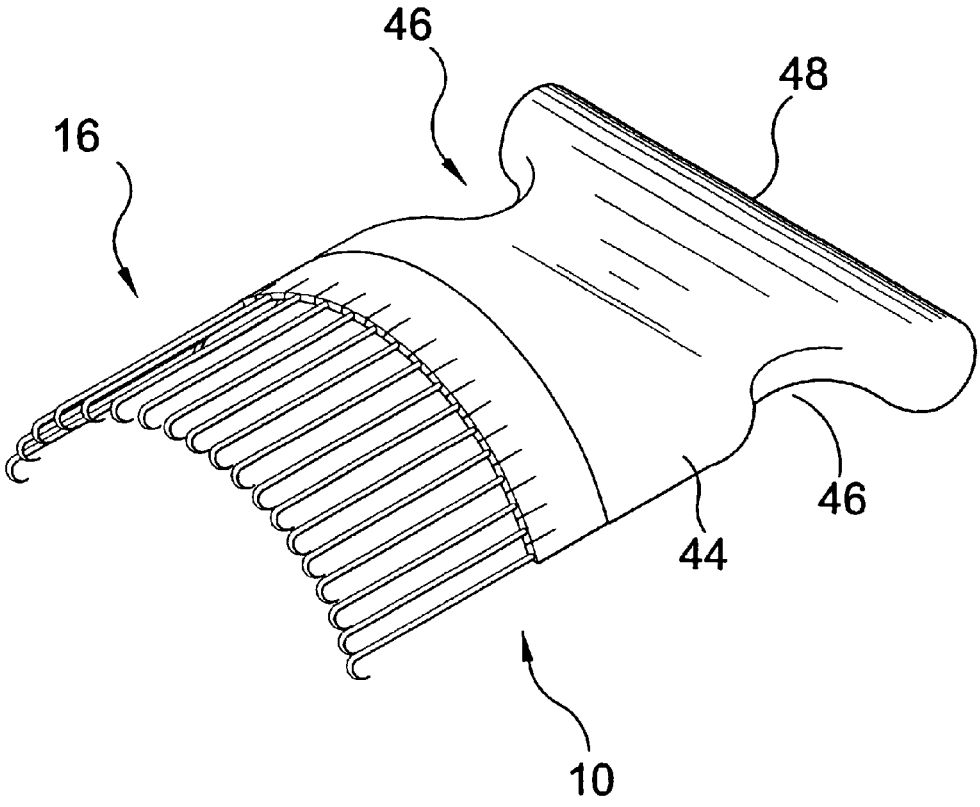
FIG. 12 is an another alternate handle for the present invention.

Turning to FIG. 12, shown therein is another alternate handle 44 for the present invention 10. Shown is the partially cylindrically shaped hair brush cleaner 10 having an alternately shaped handle 44 comprised of a solid structure wherein the opposing sides are inwardly contoured at 46 providing a grip 48 for the present invention. Tines 16 are also shown.

Figure 13:
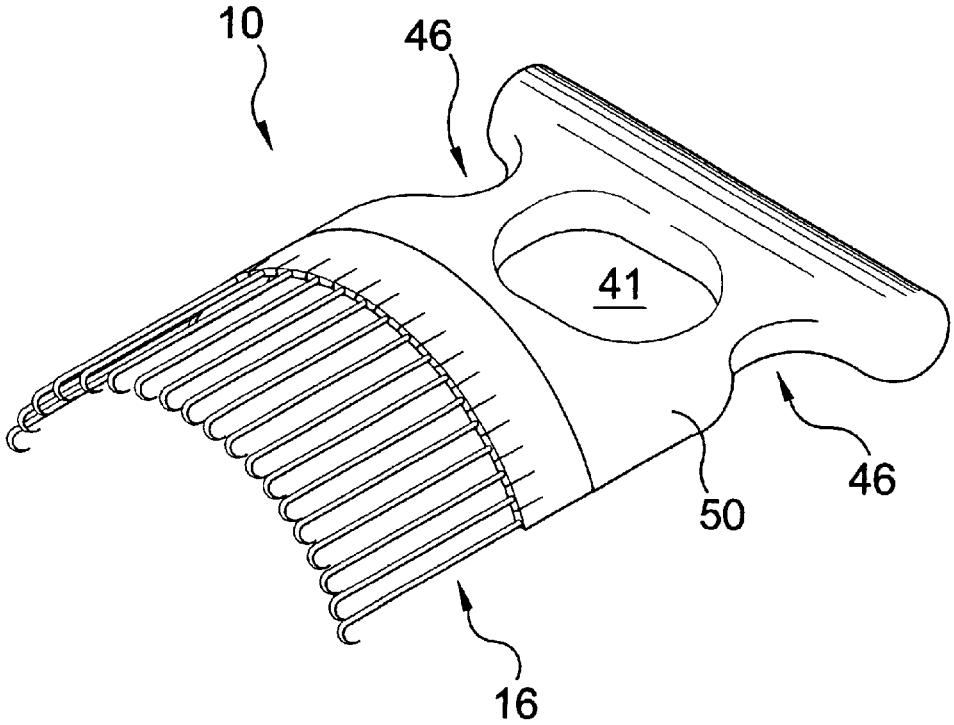
FIG. 13 is an another alternate handle for the present invention.

Turning to FIG. 13, shown therein is another alternate handle 50 for the present invention. Shown is the partially cylindrically shaped hair brush cleaner 10 having an alternately shaped handle 50 incorporating both of the priorly disclosed handle types. Shown is a handle 50 having an appropriately sized aperture 41 for inserting a number of fingers and inwardly contoured opposing sides 46 providing an additional gripping surface. Tines 16 are also shown.

I claim:

1. A hair brush cleaner for use with a cylindrical shaped hair brush, comprising:

a) an arc shaped member, said member having a first end and a second end, said arc shaped member being complementarily shaped as the cylindrical shaped hair brush;

b) a handle disposed on said first end of said arc shaped member to permit a user to grasp the cleaner;

c) a plurality of tines disposed on said second end of said arc shaped member, said tines having a proximate end and a distal end, said proximate end of said tines being disposed on said second end of said arc shaped member, said second end of said arc shaped member having a plurality of slots disposed therein;

d) wherein said slots extend into said arc shaped member to form a flexible ribbing, each of said tines having a single slot disposed thereinbetween, said slots and said tines being disposed longitudinally; and, e) wherein said tines are stiffened to cause said flexible ribbing to flex and thereby permit said tines to conform to the shape of the cylindrical shaped hair brush.

2. The apparatus of claim 1, wherein said arc shaped member forms a partial arc around a cylindrical shaped hair brush.

3. The apparatus of claim 2, further comprising a hook being disposed on said distal end of each of said tines.

4. The apparatus of claim 3, wherein said handle is elongated, having a plurality of finger grips disposed thereon for being grasped by a user.

5. The apparatus of claim 4, wherein said handle has an aperture therein, said aperture being sized to receive a plurality of fingers of a user.

6. The apparatus of claim 5, wherein said handle has a grip disposed on the distal end of said handle to permit a user to grip and to pull on the distal end of the handle.

* * * * *